United States Patent [19]

Ono

[11] Patent Number: 4,688,540

[45] Date of Patent: Aug. 25, 1987

[54] SEMICONDUCTOR WAFER DICING MACHINE

[75] Inventor: Takatoshi Ono, Nagareyama, Japan

[73] Assignee: Disco Abrasive Systems, Ltd., Tokyo, Japan

[21] Appl. No.: 813,801

[22] Filed: Dec. 27, 1985

[30] Foreign Application Priority Data

Dec. 27, 1984 [JP] Japan ..... 59-274126
May 17, 1985 [JP] Japan ..... 60-104030

[51] Int. Cl.[4] ..... B28D 1/04
[52] U.S. Cl. ..... 125/13 R
[58] Field of Search ..... 125/13 R, 14, 12

[56] References Cited

U.S. PATENT DOCUMENTS

| | | | |
|---|---|---|---|
| 2,187,299 | 1/1940 | Burkhardt | 125/13 R |
| 3,081,586 | 3/1963 | Gersbach | 125/13 R |
| 3,289,662 | 12/1966 | Garrison | 125/14 |
| 4,328,553 | 5/1982 | Fredriksen | 125/13 R |
| 4,407,262 | 10/1983 | Wirz | 125/13 R |

*Primary Examiner*—Harold D. Whitehead

*Attorney, Agent, or Firm*—Beveridge, DeGrandi & Weilacher

[57] ABSTRACT

A dicing machine for cutting a semiconductor wafer along cutting lines arranged in a lattice pattern. The dicing machine comprises a cutting station, at least one alignment station, a cutting means disposed in the cutting station, a detecting means disposed in the alignment station for detecting the cutting lines of the wafer, and a wafer transferring means. The wafer transferring means includes two wafer supporting means and the dicing machine is capable of positioning one of the two wafer supporting means in the alignment station and performing alignment of a semiconductor wafer supported with said one of the wafer supporting means while positioning the other of the wafer supporting means in the cutting station and cutting a semiconductor wafer supported with said the other of the supporting means by the cutting means. The cutting means includes two cutting blades and a cutting blade interval setting-up means for setting up the interval of these cutting blades.

15 Claims, 4 Drawing Figures

88A
4A
26A
66A
80A
78A
82A
10A
68A
30A
14A
18A
28A
24A
20A
22A
16A
90
94
74A
76A
84A
70A
34A
50A
86A
W
36A
32A
38A
44A
112
110
114
92
106
108
116
104
102
100
14B
30B
18B
72A
12
52A
96
50B
158A
98
186
158B
8
2
66B
68B
74B
86B
10B
4B
24B
26B
20B
22B
88B
16B
38B
28B
6
190
188
x
y
z

SEMICONDUCTOR WAFER DICING MACHINE

FIELD OF THE INVENTION

This invention relates to a dicing machine, and more specifically, to a dicing machine for cutting a semiconductor wafer along cutting lines arranged in a lattice pattern.

DESCRIPTION OF THE PRIOR ART

As is well known, in the production of semiconductor devices, a surface of a nearly disc-like semiconductor wafer is divided into a plurality of rectangular areas by cutting lines arranged in a lattice pattern (these cutting lines are generally called streets), and a desired circuit pattern is applied to each of these rectangular areas. Subsequently, the wafer is cut along the cutting lines to thus separate the individual rectangular areas having the circuit pattern applied thereto (these separated rectangular areas are generally called chips). It is important that the cutting of the wafer should be carried out fully acurately along the cutting lines. The width of each of the cutting lines is very narrow, and is generally about several tens of $\mu$m.

A conventional dicing machine for cutting the wafer along the cutting lines comprises a cutting station, an alignment station and a wafer supporting means. In the cutting station is disposed a cutting means having a rotating shaft and a cutting blade fixed thereto, while in the alignment station is disposed a detecting means for detecting the cutting lines of the wafer. The wafer supporting means is mounted rotatably and movably between the alignment station and the cutting station. In such a dicing machine, the wafer supporting means holding the wafer placed on its surface by vacuum attraction etc. exists in the alignment station at first. In this alignment station, the detecting means detects the cutting lines on the surface of the wafer and wafer alignment is carried out on the basis of this detection. The cutting of the wafer carried out in the cutting station later is performed by a cutting movement to linearly move the wafer supporting means supporting the wafer and the cutting means relative to each other in a predetermined direction extending perpendicularly to the central axis of the rotating shaft in the cutting means, and it is important to carry out the cutting of the wafer along the cutting lines fully accurately as described above. The aforesaid wafer alignment in the alignment station is carried out by positioning the wafer supporting means at a required position on the basis of the detection of the cutting lines so that a specific cutting line on the surface of the wafer is to be fully accurately alignment with the path of the aforesaid cutting movement at the time of the cutting. The positioning of the wafer supporting means includes rotating the wafer supporting means to position the wafer at a required angular position fully accurately. Thereafter, the wafer supporting means is moved to the cutting station and the cutting of the wafer is carried out. In this cutting, the aforesaid cutting movement and a pitch movement to linearly move the wafer supporting means and the cutting means relative to each other by the interval of the cutting lines in a direction perpendicular to the direction of this cutting movement are alternately carried out. As a result, the wafer is cut along one set of cutting lines extending substantially parallel to one another. Subsequently, the wafer supporting means or cutting means is rotated substantially through 90 degrees, and the cutting movement and the pitch movement are alternately carried out again. As a result, the wafer is cut along the other set of cutting lines extending substantially parallet to one another and substantially perpendicularly to the aforesaid one set of cutting lines. When the cutting of the wafer is finished this way, the wafer supporting means is returned to the alignment station, the cut wafer is taken out of the wafer supporting means and the next wafer to be cut is placed on the wafer supporting means.

In the meantime, the conventional dicing machine as described above has a serious problem of low dicing efficiency.

Specifically, in the first place, since the conventional dicing machine is provided with only one wafer supporting means, the cutting cannot be carried out in the cutting station while the wafer supporting means is caused to exist in the alignment station and the alignment is being carried out, and in converse with this, the alignment cannot be carried out in the alignment station while the wafer supporting means is caused to exist in the cutting station and the cutting is being carried out. Since the width of the cutting lines is very narrow as described above, it takes a considerable time to detect the cutting lines fully accurately by a pattern matching method or the like. Furthermore, since it is necessary to carry out the alignment of the wafer fully accurately as described above, it is practically impossible to terminate the performance of the alignment in a very short time. Hence, it is necessary to allocate a considerable time not only to the performance of the cutting but also to the performance of the alignment. Therefore, in the conventional dicing machine which requires a time summing up at least a time for the alignment and a time for the cutting in order to cut a single wafer, the dicing efficiencey of the wafer has been limited and a sufficiently high dicing efficiency has not been able to be attained.

In the second place, in the conventional dicing machine, since the cutting means disposed in the cutting station has only a single cutting blade, the wafer can be cut along only a single cutting line by a single cutting movement. Consequently, it is necessary to carry out the aforesaid cutting movements a number of times corresponding to the number of the cutting lines in order to cut the wafer along a large number of cutting lines existing on the surface of the wafer, and it is necessary to allocate a considerable time to the cutting in the cutting station. Due to the above fact as well, the dicing efficiency of the wafer has been limited and a sufficiently high dicing efficiency has not been able to be attained in the conventional dicing machine.

SUMMARY OF THE INVENTION

It is a primary object of this invention therefore to provide a novel and excellent wafer dicing machine having an improved dicing efficiency.

Another object of this invention is to provide a novel and excellent wafer dicing machine in which while carrying out cutting of a semiconductor wafer in a cutting station alignment of the next wafer can be carried out in an alignment station whereby its dicing efficiency is improved.

Still another object of this invention is to provide a novel and excellent dicing machine in which even if the interval between cutting lines parallel to one another varies, by appropriately coping with this variation a single cutting movement can cut the wafer along two or more than two cutting lines parallel to one another whereby its dicing efficiency is improved.

According to one aspect of this invention, there is provided a dicing machine for cutting a semiconductor wafer along cutting lines arranged in a lattice pattern, said dicing machine comprising a cutting station, at least one alignment station, cutting means disposed in the cutting station, detecting means disposed in the alignment station for detecting the cutting lines of the wafer, and wafer transferring means including two wafer supporting means mounted rotatably and movably between the alignment station and the cutting station, a main moving means for moving the wafer supporting means, and two rotating means respectively annexed to the two wafer supporting means for rotating the two wafer supporting means respectively, and said dicing machine being capable of positioning one of the two wafer supporting means in the alignment station, detecting the cutting lines of a semiconductor wafer supported with said one of the wafer supporting means by the detecting means and performing alignment including rotating said one of the wafer supporting means on the basis of this detection while positioning the other of the wafer supporting means in the cutting station and cutting a semiconductor wafer supported with said the other of the supporting means by the cutting means.

According to another aspect of this invention, there is provided a dicing machine for cutting a semiconductor wafer along cutting lines arranged in a lattice pattern, said dicing machine comprising a cutting means and a wafer supporting means, and said cutting means and wafer supporting means being adapted to be linearly moved relative to each other in a predetermined direction whereby the wafer supported with the wafer supporting means is cut by the cutting means, said cutting means including two rotating shafts extending in the y-axis direction perpendicular to the x-axis direction where the relative linear moving direction of the cutting means and wafer supporting means is the x-axis direction, two cutting blades fixed to the two rotating shafts respectively and a blade rotating means for rotating the two rotating shafts, one of said two rotating shafts being mounted linearly movable relative to the other in the y-axis direction, and said cutting means further including a cutting blade interval setting-up means for linearly moving said one of the two rotating shafts relative to said the other in the y-axis direction.

DETAILED DESCRIPTION OF THE PREFERRED EMBODIMENT

One embodiment of the dicing machine constructed in accordance with this invention will be described below in detail with reference to the accompanying drawings.

Figure 1:
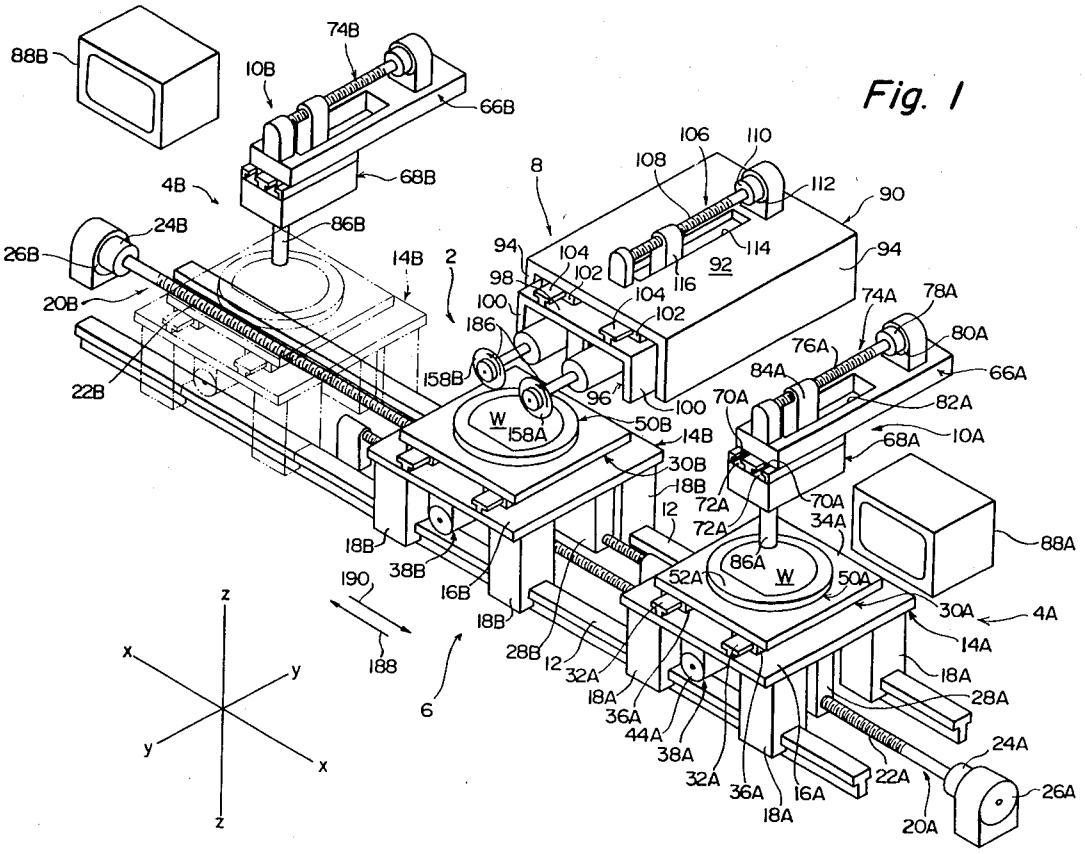
FIG. 1 is a perspective view showing a main portion of the dicing machine constructed in accordance with this invention.

With reference to FIG. 1, in the illustrated embodiment, one cutting station 2 and two alignment stations 4A and 4B are defined. The cutting station 2 is arranged in the middle of the alignment stations 4A and 4B. In other words, the alignment stations 4A and 4B are arranged on both sides of the cutting station 2 respectively. The illustrated embodiment comprises a wafer transferring means shown generally at 6, a cutting means disposed in the cutting station 2 and shown generally at 8, and detecting means 10A and 10B disposed in the alignment stations 4A and 4B respectively.

The illustrated wafer transferring means 6 includes two static support rails 12 fixed to a suitable support structure (not shown) and extending substantially horizontally and parallel to each other. Each of the support rails 12 is formed of a substantially straight long member having a T-shaped section. For convenience of explanation, the direction in which the support rails 12 extend is made the x-axis direction. Two main movable frames 14A and 14B are slidably mounted on the support rails 12. The main movable frames 14A and 14B respectively have horizontal plates 16A and 16B, and four posts 18A and four posts 18B hanging down from the four corner portions of the under surface of the horizontal plates 16A and 16B respectively. In the lower ends of the four posts 18A and four posts 18B are formed grooves having a T-shaped section corresponding to the sectional shape of the support rails 12. By engaging these grooves with the support rails 12, the main movable frames 14A and 14B are separately and independently mounted slidably in the x-axis direction along the support rails 12 respectively. To the main movable frames 14A and 14B are respectively annexed main moving means 20A and 20B for moving them in the x-axis direction. The main moving means 20A annexed to the main movable frame 14A is rotatably mounted on the support structure (not shown), and includes a male screw rod 22A extending in the x-axis direction and a driving source 26A such as a pulse motor mounted on the support structure and drivingly connected to the male screw rod 22A through a speed reduction mechanism 24A. On the other hand, to the under surface of the horizontal plate 16A is fixed a connection member 28A hanging downwardly, and in this connection member 28A is formed a through female screw hole extending in the x-axis direction. The male screw rod 22A is engaged with this female scew hole. Hence, when rotating the male screw rod 22A by the driving source 26A, the main movable frame 14A is linearly moved in the x-axis direction. Similarly, the main moving means 20B annexed to the main movable frame 14B also includes a male scew rod 22B and a driving source 26B drivingly connected to the male screw rod 22B through a speed reduction mechanism 24B, and the male screw rod 22B is engaged with a through female screw hole formed in a connection member 28B fixed to the under surface of the horizontal plate 16B. Hence, when rotating the male screw rod 22B by the driving source 26B, the main movable frame 14B is linearly moved in the x-axis direction.

Figure 2:
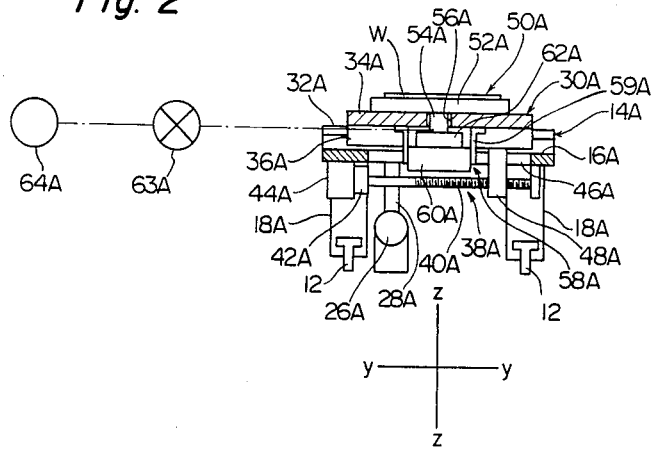
FIG. 2 is a sectional view showing a main movable frame and various constituents provided thereto of a wafer transferring means in the dicing machine of FIG. 1.

With reference to FIG. 2 as well as FIG. 1, the main movable frame 14A is provided with a subsidiary movable frame 30A. Two support rails 32A extending substantially horizontally and substantially perpendicularly to the x-axis direction are formed on the upper surface of the horizontal plate 16A of the main movable frame 14A. For convenience of explanation, the direction in which the support rails 32A exist is made the y-axis direction. The sectional shape of each of these support rails 32A is T-shaped. The subsidiary movable frame 30A has a horizontal plate 34A, and two protrusions 36A extending parallel to each other are formed on the under surface of this horizontal plate 34A. In each of protrusions 36A is formed a groove having a T-shaped section corresponding to the sectional shape of the support rails 32A. By engaging these grooves with the support rails 32A, the subsidiary movable frame 30A is mounted slidably in the y-axis direction along the support rails 32A. To the subsidiary movable frame 30A is annexed a subsidiary moving means 38A for moving it in the y-axis direction. The subsidiary moving means 38A includes a male screw rod 40A rotatably mounted on the under surface of the horizontal plate 16A of the main movable frame 14A and extending in the y-axis direction, and a driving source 44A such as a pulse motor mounted on the under surface of the horizontal plate 16A and drivingly connected to the male screw rod 40A through a speed reduction mechanism 42A. A slot 46A extending in the y-axis direction is formed in the horizontal plate 16A of the main movable frame 14A and a connection member 48A hanging downwardly through the slot 46A is fixed to the under surface of the horizontal plate 34A of the subsidiary movable frame 30A. A through female screw hole extending in the y-axis direction is formed in this connection member 48A and the male screw rod 40A is engaged with this female screw hole. Hence, when the male screw rod 40A is rotated by the driving source 44A, the subsidiary movable frame 30A is linearly moved in the y-axis direction to the main movable frame 14A.

A wafer supporting means 50A is mounted on the subsidiary movable frame 30A. As illustrated in FIG. 2, the wafer supporting means 50A has a horizontal disc 52A on whose upper surface a semiconductor wafer W is placed, and a shaft 54A hanging down substantially vertically from the center of the under surface of this disc 52A. On the other hand, a substantially vertical through hole is formed at the center in the horizontal plate 34A of the subsidiary movable frame 30A. The shaft 54A is rotatably mounted in the aforesaid through hole via a suitable bearing member 56A, and thus the wafer supporting means 50A is mounted on the subsidiary movable frame 30A for rotation about its substantially vertically extending central axis as a center. To the wafer supporting means 50A is annexed a rotating means 58A for rotating it. This rotating means 58A includes a driving source 60A such as a pulse motor mounted on the under surface of the horizontal plate 34A of the subsidiary movable frame 30A through a mounting member 61A. The driving source 60A is drivingly connected to the shaft 54A of the wafer supporting means 50A through a speed reduction mechanism 62A. Hence, the wafer supporting means 50A is rotated by the driving source 60A. At least a part of the disc 52A of the wafer supporting means 50A is made of a porous material such as a porous ceramic and a suitable suction passage (not shown) is formed in the shaft 54A of the wafer supporting means 50A. This suction passage is connected to a vacuum source 64A through a conduit having a control valve 63A. Upon communication of the suction passage with the vacuum source 64A air is sucked through the disc 52A and thus the wafer W placed on the disc 52A is attracted to the disc 52A under vacuum. Instead of making at least a part of the disc 52A of a porous material, a plurality of suction holes may be formed in the disc 52A.

With reference to FIG. 1, similarly, a subsidiary movable frame 30B is mounted on the main movable frame 14B for movement in the y-axis direction and a wafer supporting means 50B is mounted on the subsidiary movable frame 30B for rotation about its substantially vertically extending central axis as a center. To the subsidiary movable frame 30B is annexed a subsidiary moving means 38B for linearly moving it in the y-axis direction, and to the wafer supporting means 50B is annexed a rotating means (not shown) for rotating it. The subsidiary movable frame 30B and subsidiary moving means 38B annexed thereto, and the wafer supporting means 50B and rotating means (not shown) annexed thereto may be the same as the aforesaid subsidiary movable frame 30A and subsidiary moving means 38A annexed thereto, and the wafer supporting means 50A and rotating means 58A annexed thereto. Therefore, a detailed description about them is omitted in this specification.

In the next place, the detecting means 10A disposed in the alignment station 4A is described. With reference to FIG. 1, at the upper portion of the alignment station 4A is disposed a static support base 66A fixed to the suitable support structure (not shown). A movable frame 68A is mounted on the under surface of this support base 66A. On the under surface of the support base 66A are formed two support rails 70A extending in the y-axis direction and having a T-shaped section (only a very small part of them is illustrated in FIG. 1). On the other hand, in the upper surface of the movable frame 68A are formed two grooves 72A having a T-shaped section corresponding to the sectional shape of the support rails 70A, and by engaging these grooves 72A with the support rails 70A the movable frame 68A is mounted slidably in the y-axis direction along the support rails 70A. To the movable frame 68A is annexed a moving means 74A for moving it in the y-axis direction. This moving means 74A includes a male screw rod 76A rotatably mounted on the upper surface of the support base 66A and extending in the y-axis direction, and a driving source 80A such as a pulse motor mounted on the upper surface of the support base 66A and drivingly connected to the male screw rod 76A through a speed reducer 78A. A slot 82A extending in the y-axis direction is formed in the support base 66A and a connection member 84A protruding upwardly through the slot 82A is fixed to the upper surface of the movable frame 68A. In this connection member 84A is formed a through female screw hole extending in the y-axis direction, and with this female screw hole is engaged the male screw rod 76A. Therefore, when the male screw rod 76A is rotated by the driving source 80A, the movable frame 68A is linearly moved in the y-axis direction to the support base 66A.

On the movable frame 68A is mounted a microscope 86A which constitutes an optical input means of the detecting means 10A. The optical central axis of the microscope 86A which may be of a relatively low magnification extends substantially vertically. For convenience of explanation, the direction of the optical central axis of the microscope 86A, i.e. the vertical direction is made the z-axis direction. The detecting means 10A also includes an electronic treating means (not shown) for suitably treating an image coming in through the microscope 86A (therefore, an image of a part of the surface of the wafer W placed on the wafer supporting means 50A). This treating means carries out a pattern matching treatment or the like to detect cutting lines on the surface of the wafer W. For example the means disclosed in U.S. patent application Ser. No. 551,820 of Shinichi TAMURA et al. (Filed: Nov. 15, 1983; Title of the invention: Automatic accurate alignment system), U.S. patent application Ser. No. 732,219 of Masanori UGA (Filed: May 9, 1985; Title of the invention: Automatic accurate alignment system) both having common ownership with the present application and UK Patent Application No. GB 2,139,348A (published on Nov. 7, 1984) are preferably used for this treating means. Therefore, by citing the description of the specifications of the U.S. and UK patent applications into this specification, a detailed description about the treating means is omitted in this specification. The detecting means 10A further includes a display means 88A such as a CRT (cathode-ray tube) for magnifying an image entering the microscope 86A and for visually displaying it. This display means 88A is mounted on the suitable support structure (not shown).

Similarly, at the upper portion of the alignment station 4B are also disposed a static support base 66B, a movable frame 68B and a moving means 74B. On the movable frame 68B is mounted a microscope 86B which constitutes an optical input means of the detecting means 10B. The detecting means 10B includes an electronic treating means and a display means 88B. Since these means provided with respect to the alignment station 4B may be substantially the same as the aforesaid means provided with respect to the alignment station 4A, a detailed description about these means is omitted.

In the next place, the cutting means 8 disposed in the cutting station 2 is described. With reference to FIG. 1, a static support base 90 fixed to the suitable support structure (not shown) is disposed at the upper portion of the cutting station 2. This support base 90 has a horizontal plate portion 92 and side plate portions 94 hanging downwardly respectively from both sides of this horizontal plate portion 92. A movable main support frame 96 having a horizontal plate portion 98 and side plate portions 100 hanging downwardly respectively from both sides of this horizontal plate portion 98 is mounted on the support base 90. Specifically, two protrusions 102 extending in the y-axis direction are provided on the under surface of the horizontal plate portion 92 of the support base 90 and two grooves extending in the y-axis direction and having a T-shaped section are formed in these protrusions 102 respectively. On the other hand, two support rails 104 having a T-shaped sectional shape corresponding to the sectional shape of the grooves are formed on the upper surface of the horizontal plate portion 98 of the main support frame 96. By engaging the support rails 104 with the grooves, the main support frame 96 is mounted on the support base 90 movably in the y-axis direction along the grooves. To the main support frame 96 is annexed a y-axis direction moving means 106 for moving it in the y-axis direction. This moving means 106 includes a male screw rod 108 rotatably mounted on the upper surface of the horizontal plate portion 92 of the support base 90 and extending in the y-axis direction, and a driving source 112 such as a pulse motor mounted on the upper surface of the horizontal plate portion 92 of the support base 90 and drivingly connected to the male screw rod 108 through a speed reducer 110. A slot 114 extending in the y-axis direction is formed in the horizontal plate portion 92 of the support base 90, and a connection member 116 protruding upwardly through the slot 114 is fixed to the upper surface of the horizontal plate portion 98 of the main support frame 96. A through female screw hole extending in the y-axis direction is formed in this connection member 116, and the male screw rod 108 is engaged with this female screw hole. Therefore, when the male screw rod 108 is rotated by the driving source 112, the main support frame 96 is linearly moved in the y-axis direction to the support base 90.

Figure 3:
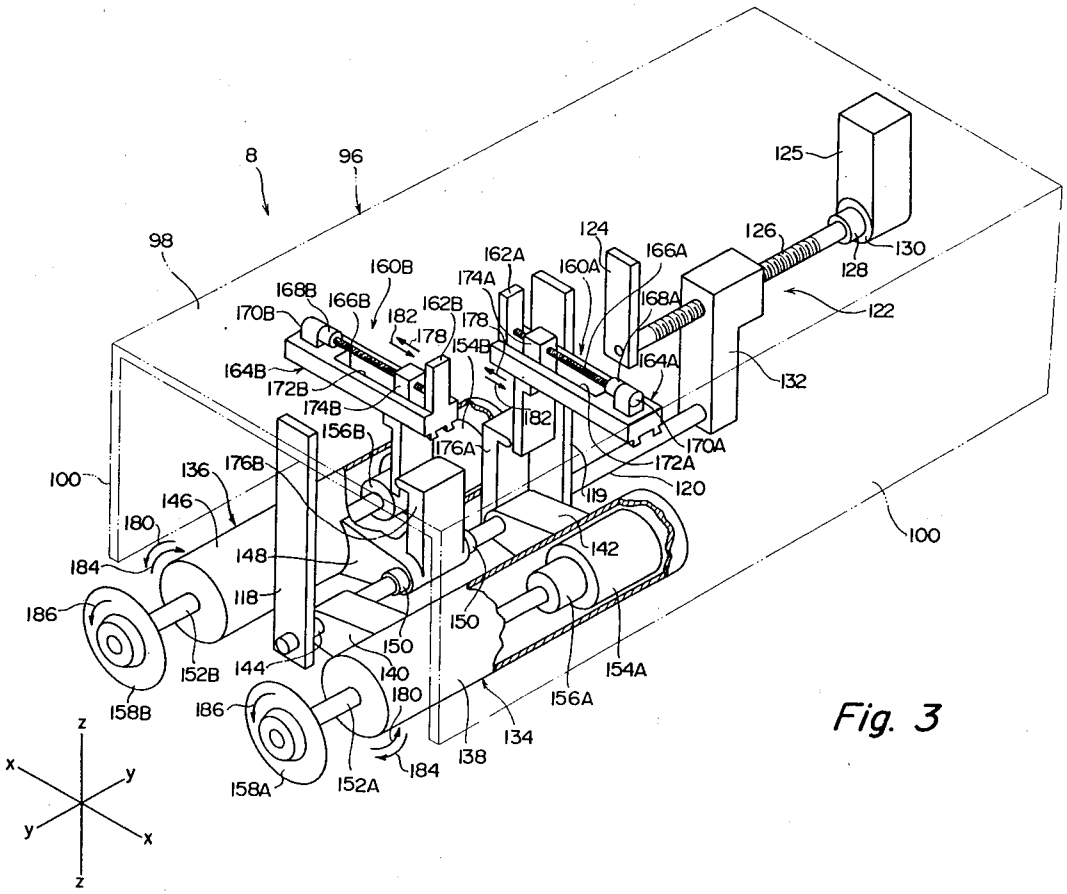
FIG. 3 is a partially broken perspective view showing a main portion of a cutting means in the dicing machine of FIG. 1.

With reference to FIG. 3 as well as FIG. 1, a pair of hanging plates 118 and 119 hanging downwardly at a predetermined spaced interval in the y-axis direction is fixed to the under surface of the horizontal plate portion 98 of the main support frame 96. A support shaft 120 extending in the y-axis direction is mounted on the lower end portions of this pair of hanging plates 118 and 119 for movement in the y-axis direction. To the support shaft 120 is annexed a cutting blade interval setting-up means 122 for moving it in the y-axis direction. In respect of this setting-up means 122, a pair of hanging plates 124 and 125 hanging downwardly at a predetermined spaced interval in the y-axis direction is further fixed to the under surface of the horizontal plate portion 98 of the main support frame 96, and the setting-up means 122 includes a male screw rod 126 rotatably mounted between the pair of hanging plates 124 and 125 and extending in the y-axis direction, and a driving source 130 such as a pulse motor mounted on the hanging plate 125 and drivingly connected to the male screw rod 126 through a speed reduction mechanism 128. An upwardly extending connection member 132 is fixed to the rear end portion of the support shaft 120. A through female screw hole extending in the y-axis direction is formed in this connection member 132, and the male screw rod 126 is engaged with this female screw hole. Therefore, when the male screw rod 126 is rotated by the driving source 130, the support shaft 120 is linearly moved in the y-axis direction to the main support frame 96.

A first subsidiary support frame 134 and a second subsidiary support frame 136 are mounted on the support shaft 120. The first subsidiary support frame 134 has a hollow cylindrical main portion 138 and a pair of connection arms 140 and 142 protruding from the main portion 138 at a predetermined spaced interval in the y-axis direction. The pair of connection arms 140 and 142 are pivotably connected to the support shaft 120, and thus the first subsidiary support frame 134 is mounted on the main support frame 96 for pivoting about the central axis of the support shaft 120 as a center. A sleeve 144 is loosely fitted on the support shaft 120 between the hanging plate 118 on which the support shaft 120 is mounted and the connection arm 140 of the first subsidiary support frame 134. Similarly, a sleeve (not shown) is loosely fitted on the support shaft 120 between the hanging plate 119 on which the support shaft 120 is mounted and the connection arm 142 of the first subsidiary support frame 134. These sleeves prevent the first subsidiary support frame 134 from moving in the y-axis direction to the hanging plates 118 and 119, and therefore prevents the first subsidiary support frame 134 from moving in the y-axis direction to the main support frame 96. The second subsidiary support frame 136 has a hollow cylindrical main portion 146 and a connection arm 148 protruding from this main portion 146. The connection arm 148 is pivotably connected to the support shaft 120, and thus the second subsidiary support frame 136 is mounted on the main support frame 96 for pivoting about the central axis of the support shaft 120 as a center. Sleeves 150 are fixed to the support shaft 120 at both sides of the connection arm 148 of the second subsidiary support frame 136. These sleeves 150 prevent the second subsidiary support frame 136 from moving in the y-axis direction to the support shaft 120. As is understood from the above description, when the main support frame 96 and the support shaft 120 mounted thereon are moved in the y-axis direction by the y-axis direction moving means 106 (FIG. 1), both of the first subsidiary support frame 134 and second subsidiary support frame 136 are moved in the y-axis direction accordingly. On the other hand, when the support shaft 120 is moved in the y-axis direction to the main support frame 96 by the cutting blade interval setting-up means 122, the first subsidiary support frame 134 is not moved in the y-axis direction, but only the second subsidiary support frame 136 is moved in the y-axis direction together with the support shaft 120.

With reference to FIG. 3, on the main portion 138 of the first subsidiary support frame 134 is rotatably mounted a rotating shaft 152A and is mounted a blade rotating means 154A for rotating this rotating shaft 152A. The rotating means 154A may be a DC motor whose output shaft is drivingly connected to the rotating shaft 152A by a suitable coupling means 156A. The rotating shaft 152A protrudes in front beyond the main portion 138 and a thin disc-shaped cutting blade 158A is fixed to its protruding end portion. Similarly, on the main portion 146 of the second subsidiary support frame 136 is rotatably mounted a rotating shaft 152B and is mounted a blade rotating means 154B such as a DC motor whose output shaft is drivingly connected to the rotating shaft 152B through a suitable coupling means 156B. A thin disc-shaped cutting blade 158B is fixed to the protruding end portion of the rotating shaft 152B protruding in front beyond the main portion 146. The cutting blades 158A and 158B themselves may be known ones containing natural or synthetic diamond abrasive grains and being suitable for cutting of semiconductor wafers.

The cutting means 8 further includes a z-axis direction moving means for elevating and lowering the rotating shafts 152A and 152B, and the cutting blades 158A and 158B fixed thereto in the z-axis direction. In the illustrated embodiment, the z-axis direction moving means comprises a first pivoting means 160A for causing the first subsidiary support frame 134 to pivot about the central axis of the support shaft 120 as a center and a second pivoting means 160B for causing the second subsidiary support frame 136 to pivot about the central axis of the support shaft 120 as a center. With reference to FIG. 3, the first pivoting means 160A includes a support frame 164A whose one end is fixed to the inner surface of one of the side plate portions 100 of the main support frame 96 and whose the other end is fixed to the under surface of the horizontal plate portion 98 of the main support frame 96 through an upwardly extending connection member 162A. On the upper surface of this support frame 164A is rotatably mounted a male screw rod 166A extending in the x-axis direction and is mounted a driving source 170A such as a pulse motor drivingly connected to the male screw rod 166A through a suitable speed reduction mechanism 168A. The first pivoting means 160A further includes a working member 174A extending in the z-axis direction through a slot 172A formed in the support frame 164A. A through female screw hole extending in the x-axis direction is formed in the upper end portion of this working member 174A and the male screw rod 166A is engaged with this female screw hole. On the other hand, at the head end of the connection arm 142 of the first subsidiary support frame 134 is unitedly formed a nearly L-like non-working member 176A extending upwardly therefrom. The free end portion preferably having a semicircular sectional shape of this non-working member 176A is caused to abut against one surface of the lower end portion of the working member 174A. When the male screw rod 166A is rotated by the driving source 170A to move the working member 174A in the direction shown by an arrow 178, the free end portion of the non-working member 176A is moved in the direction shown by the arrow 178 according to the movement of the working member 174A. Thus, the first subsidiary support frame 134 is caused to pivot about the central axis of the support shaft 120 as a center in the direction shown by an arrow 180 whereby the rotating shaft 152A and the cutting blade 158A fixed thereto are elevated while tracing a circular arc. In contrast with this, when the male screw rod 166A is rotated by the driving source 170A to move the morking member 174A in the direction shown by an arrow 182, the first subsidiary support frame 134 is accordingly caused to pivot about the central axis of the support shaft 120 as a center in the direction shown by an arrow 184 due to its own weight and the free end portion of the non-working member 176A keeps abutting against the one surface of the working member 174A. Thus, the rotating shaft 152A and the cutting blade 158A fixed thereto are lowered while tracing a circular arc. The second pivoting means 160B disposed with reference to the second subsidiary support frame 136 has also substantially the same structure as the first pivoting means 160A and includes a support frame 164B whose one end is fixed to the inner surface of the other of the side plate portions 100 of the main support frame 96 and whose the other end is fixed to the under surface of the horizontal plate portion 98 of the main support frame 96 through an upwardly extending connection member 162B. On the upper surface of this support frame 164B is rotatably mounted a male screw rod 166B extending in the x-axis direction and is mounted a driving source 170B such as a pulse motor drivingly connected to the male screw rod 166B through a suitable speed reduction mechanism 168B. The second pivoting means 160B further includes a working member 174B extending in the z-axis direction through a slot 172B formed in the support frame 164B. A through female screw hole extending in the x-axis direction is formed in the upper end portion of this working member 174B and the male screw rod 166B is engaged with this female screw hole. On the other hand, at the head end of the connection arm 148 of the second subsidiary support frame 136 is unitedly formed a nearly L-like non-working member 176B extending upwardly therefrom. The free end portion preferably having a semicircular sectional shape of this non-working member 176B is caused to abut against one surface of the lower end portion of the working member 174B. When the male screw rod 166B is rotated by the driving source 170B to move the working member 174B in the direction shown by an arrow 182, the free end portion of the non-working member 176B is moved in the direction shown by the arrow 182 according to the movement of the working member 174B. Thus, the second subsidiary support frame 136 is caused to pivot about the central axis of the support shaft 120 as a center in the direction shown by an arrow 184 whereby the rotating shaft 152B and the cutting blade 158B fixed thereto are elevated while tracing a circular arc. In contrast with this, when the male screw rod 166B is rotated by the driving source 170B to move the working member 174B in the direction shown by an arrow 178, the second subsidiary support frame 136 is accordingly caused to pivot about the central axis of the support shaft 120 as a center in the direction shown by an arrow 180 due to its own weight and the free end portion of the non-working member 176B keeps abutting against the one surface of the working member 174B. Thus, the rotating shaft 152B and the cutting blade 158B fixed thereto are lowered while tracing a circular arc.

Figure 4:
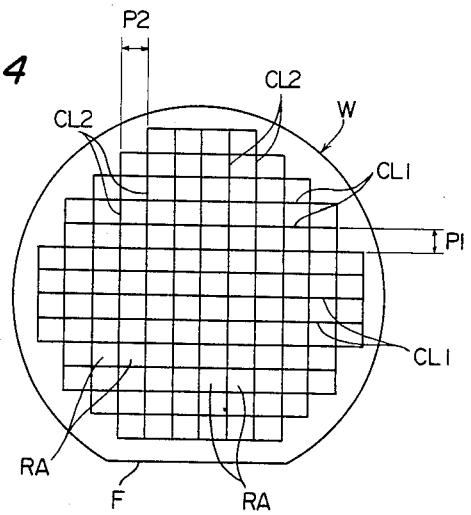
FIG. 4 is a top plan view showing one example of a semiconductor wafer to be diced by the dicing machine of FIG. 1.

FIG. 4 illustrates one example of a semiconductor wafer W to be diced by the dicing machine according to this invention. A number of cutting lines CL1 and CL2 arranged in a lattice pattern are disposed on a surface of the wafer W which is nearly discshaped except for a flat portion F generally called an orientation flat, and a number of rectangular areas RA are defined by these cutting lines CL1 and CL2. The cutting lines CL1 and CL2 include a first set of cutting lines CL1 extending parallel to one another at predetermined spaced intervals P1, and a second set of cutting lines CL2 extending parallel to one another at predetermined spaced intervals P2 and substantially perpendicularly to this first set of cutting lines CL1. The interval P1 between adjacent cutting lines in the first set of cutting lines CL1 and the interval P2 between adjacent cutting lines in the second set of cutting lines CL2 are occasionally substantially the same, but are generally different from each other ($P1 \neq P2$). A required curcuit pattern is applied to each of the rectangular areas RA.

A dicing operation of the wafer W in the dicing machine as described above according to this invention will be described as follows:

With reference to FIG. 1 and FIG. 3, in the dicing machine as described above, prior to actually dicing the wafer W, mutual alignment in the y-axis direction of the cutting blades 158A and 158B in the cutting means 8 and the optical centers of the microscopes 86A and 86B in the detecting means 10A and 10B is carried out. In one example of this mutual alignment operation, at first, the main support frame 96 mounted for movement in the y-axis direction to the static support base 90 in the cutting means 8 is positioned at a predetermined initial position, and the second subsidiary support frame 136 mounted for movement in the y-axis direction to the main support frame 96 is positioned at a predetermined initial position. Then, theoretically, the y-axis direction position of the cutting blade 158A fixed to the rotating shaft 152A mounted on the first subsidiary support frame 134 and the y-axis direction position of the cutting blade 158B fixed to the rotating shaft 152B mounted on the second subsidiary support frame 136 agree with each other. Subsequently, in the wafer transferring means 6, as shown by solid line in FIG. 1 for example, the main movable frame 14A is located in the alignment station 4A by the main moving means 20A and the main movable frame 14B is located in the cutting station 6 by the main moving means 20B. Then, a dummy wafer (this dummy wafer may be one to which neither cutting lines CL1 and CL2 nor circuit patterns are applied ) is placed on the wafer supporting means 50B mounted on the main movable frame 14B existing in the cutting station 6 and it is held by suction. Thereafter, in the cutting means 8, the first subsidiary support frame 134 is caused to pivot through a predetermined angle in the direction shown by the arrow 184 in FIG. 3 by the first pivoting means 160A to thus lower the cutting blade 158A down to a cutting position interfering with the dummy wafer on the wafer supporting means 50B. (At this time, the other cutting blade 158B is being elevated up to a non-cutting position not interfering with the dummy wafer on the wafer supporting means 50B.) Subsequently, the rotating means 154A is energized to rotate the cutting blade 158A in the direction shown by an arrow 186 at a speed of 15,000 to 20,000 r.p.m. for example and the main movable frame 14B is moved by a predetermined distance in the direction shown by an arrow 188 at a relatively low speed of about 100 mm/sec for example by the main moving means 20B to thus actually cut the dummy wafer by the cutting blade 158A. Thereafter, the rotation of the cutting blade 158A is stopped and the first subsidiary support frame 134 is caused to pivot through a predetermined angle in the direction shown by the arrow 180 in FIG. 3 by the first pivoting means 160A to thus elevate the cutting blade 158A up to a non-cutting position not interfering with the dummy wafer on the wafer supporting means 50B. Subsequently, as shown by two-dot chain line in FIG. 1, the main movable frame 14B is moved in the direction shown by the arrow 188 by the main moving means 20B and is located in the alignment station 4B. Thereafter, by looking at the display means 88B visually displaying an image coming in the microscope 86B, the actual cut line in the dummy wafer is observed. It is examined whether the optical center of the microscope 86B, therefore the center of the display screen of the display means 88B and the actual cut line are in accurate agreement in the y-axis direction or not. If the actual cut line and the optical center of the microscope 86B are not in accurate agreement in the y-axis direction, the movable frame 68B and the microscope 86B mounted thereon are moved by a required distance in the y-axis direction by the moving means 74B to accurately agree the y-axis direction position of the optical center of the microscope 86B with the actual cut line. Consequently, the mutual alignment of the cutting blade 158A and the detecting means 10B is established. Thereafter, substantially similarly to the aforesaid procedures, mutual alignment of the cutting blade 158A and the detecting means 10A is carried out. Specifically, the main movable frame 14A is moved in the direction shown by the arrow 188 by the main moving means 20A and is located in the cutting station 6. Subsequently, the dummy wafer is placed on the wafer supporting means 50A mounted on the main movable frame 14A and it is held by suction. Thereafter, the cutting blade 158A is lowered down to a cutting position. Subsequently, the cutting blade 158A is rotated in the direction shown by the arrow 186 and the main movable frame 14A is moved by a predetermined distance in the direction shown by the arrow 188 by the main moving means 20A to thus actually cut the dummy wafer by the cutting blade 158A. Thereafter, the rotation of the cutting blade 158A is stopped and the cutting blade 158A is elevated up to a non-cutting position. Subsequently, the main movable frame 14A is moved in the direction shown by an arrow 190 by the main moving means 20A and is located in the alignment station 4A. Thereafter, by looking at the display means 88A visually displaying an image coming in the microscope 86A, the actual cut line in the dummy wafer is observed. If necessary, the movable frame 68A and the microscope 86A mounted thereon are moved by a required distance in the y-axis direction by the moving means 74A to accurately agree the y-axis direction position of the optical center of the microscope 86A with the actual cut line. Consequently, the mutual alignment of the cutting blade 158A and the detecting means 10A is established. In the one example of the mutual alignment operation, confirmation of mutual alignment of the initial position of the cutting blade 158A and the initial position of the cutting blade 158B is further carried out. In this confirmation, the main movable frame 14A (or the main movable frame 14B) is located in the cutting station 6, and the dummy wafer is placed on the wafer supporting means 50A mounted on the main movable frame 14A and it is held by suction. Subsequently, the second subsidiary support frame 136 is caused to pivot through a predetermined angle in the direction shown by the arrow 180 in FIG. 3 by the second pivoting means 160B to thus lower the cutting blade 158B down to a cutting position interfering with the dummy wafer on the wafer supporting means 50A. (At this time, the other cutting blade 158A is being elevated up to a non-cutting position.) Subsequently, the rotating means 154B is energized to rotate the cutting blade 158B in the direction shown by the arrow 186 and the main movable frame 14A is moved by a predetermined distance in the direction shown by the arrow 188 to thus actually cut the dummy wafer by the cutting blade 158B. Thereafter, the rotation of the cutting blade 158B is stopped and the second subsidiary support frame 136 is caused to pivot through a predetermined angle in the direction shown by the arrow 184 in FIG. 3 by the second pivoting means 160B to thus elevate the cutting blade 158B up to a non-cutting position not interfering with the dummy wafer on the wafer supporting means 50A. Subsequently, the main movable frame 14A is moved in the direction shown by the arrow 190 by the main moving means 20A and is located in the alignment station 4A. Thereafter, it is examined whether or not the y-axis direction position of the actual cut line of the dummy wafer is in accurate agreement with the optical center of the microscope 86A by looking at the display means 88A visually displaying an image coming in the microscope 86A. If there is an offset between the y-axis direction position of the actual cut line and the optical center of the microscope 86A, the second subsidiary support frame 136 is moved by the distance of the aforesaid offset in the y-axis direction by the cutting blade interval setting-up means 122 in the cutting means 8 to correct the initial position of the cutting blade 158B, and thus the y-axis direction position in the initial position of the cutting blade 158B is caused to be in fully accurate agreement with the y-axis direction position in the initial position of the cutting blade 158A.

Dicing operation of the wafer W effected after the above-described preparatory mutual alignment operation is carried out is as follows: In the abovedescribed dicing machine according to this invention, when one of the two main movable frames 14A and 14B in the wafer transferring means 6, for example, the main movable frame 14B exists in the cutting station 2, the other of the two main movable frames 14A and 14B, i.e. the main movable frame 14A exists in the alignment station 4A. In the cutting station 2, dicing of the wafer W placed on the wafer supporting means 50B to be held by suction thereto and already aligned as required in the alignment station 4B as will be described hereinafter is carried out. During this time, in the alignment station 4A, at first, the control valve 63A (FIG. 2) is switched to part the suction passage of the wafer supporting means 50A from the vacuum source 64A, suction of the wafer W already diced as required in the cutting station 2 to be described hereinafter is stopped, and the wafer W is taken out of the wafer supporting means 50A by a suitable loading and unloading means (not shown). Then, the next wafer W to be diced is placed on the wafer supporting means 50A by the loading and unloading means. The wafer W to be diced is placed on the wafer supporting means 50A by itself, or, as is well known among those skilled in the aret, is placed on the wafer supporting means 50A in the state that it is mounted on a frame (not shown) surrounding the wafer W by means of tape applied over to the back surface of the wafer W and the back surface of the frame. In both cases, the wafer W is placed on the wafer supporting means 50A with its surface having the cutting lines CL1 and CL2 (FIG. 4) disposed thereon facing upwardly and within a certain error limit, although not sufficiently accurately, by making its flat portion F a standard or making positioning notches formed in the frame on which it is mounted a standard. Subsequently, the control valve 63 (FIG. 2) is switched again to connect the suction passage of the wafer supporting means 50A to the vacuum source 64A to thus hold the wafer W on the wafer supporting means 50A by suction. Thereafter, fully accurate alignment is automatically carried out on the basis of detection of specific cutting lines CL1 and/or CL2 on the surface of the wafer W by the detecting means 10A. This alignment includes detecting the inclination of the cutting line CL1 (or CL2) to the x-axis direction standard line extending in the x-axis direction through the optical center of the microscope 86A in the detecting means 10A, rotating the wafer supporting means 50A by the rotating means 58A (FIG. 2) according to the detected inclination, and thus causing the cutting line CL1 (or CL2) to be fully accurately parallel to the x-axis direction standard line. Furthermore, in the illustrated embodiment, it also includes detecting the offset between the y-axis direction position of the x-axis direction standard line and a specific cutting line CL1 (or CL2), moving the subsidiary movable frame 30A in the y-axis direction to the main movable frame 14A by the subsidiary moving means 38A according to the detected offset, and thus causing the y-axis direction position of the specific cutting line CL1 (or CL2) to fully accurately agree with the y-axis direction position of the x-axis direction standard line. Such an automatic alignment may be preferably carried out by the systems as described in detailed in the aforesaid U.S. patent application Ser. No. 551,820 of Shinichi Tamura et al., U.S. patent application Ser. No. 732,219 of Masanori UGA and UK Patent Application No. GB 2,139,348A. Therefore, by citing the description of the U.S. patent applications and the British laid-open patent specification into this specification, its detailed description is omitted in this specification.

When, in the alignment station 4A, the alignment of the wafer W placed on the wafer supporting means 50A and attracted thereto is finished as described above, and, in the cutting station 2, dicing of the wafer W placed on the wafer supporting means 50B and held thereto is finished, the wafer supporting means 50B is moved to the alignment station 4B and the wafer supporting means 50A is moved to the cutting station 2. More specifically, the main movable frame 14B is moved in the direction shown by the arrow 188 by the main moving means 20B and caused to exist in the alignment station 4B as shown by two-dot chain line in FIG. 1. Simultaneously, the main movable frame 14A is moved in the direction shown by the arrow 188 by the main moving means 20A and caused to exist in the cutting station 2. In the alignment station 4B, substantially the same procedures as the aforesaid procedures with respect to the alignment station 4A are carried out. Specifically, while the main movable frame 14B is at a standstill at a predetermined position, at first, suction of the wafer W by the wafer supporting means 50B is stopped and the wafer W already diced is taken out of the wafer supporting means 50B by a suitable loading and unloading means (not shown). Subsequently, the next wafer W to be diced is placed on the wafer supporting means 50B by the loading and unloading means and is held thereto by suction, and thereafter, fully accurate automatic alignment is carried out on the basis of detection of specific cutting lines CL1 and/or CL2 on the surface of the wafer W by the detecting means 10B. On the other hand, in the cutting station 2, dicing of the wafer W held by suction onto the wafer supporting means 50A is carried out.

The dicing of the wafer W to be carried out in the cutting station 2 is described below in detail with refernce to FIG. 3 as well as FIG. 1. Just before the dicing of the wafer W is actually carried out in the cutting station 2, the main movable frame 14A is stopped at a one-side deviation position deviated from the x-axis direction center of the cutting station 2 in the direction shown by the arrow 190 so that the entire wafer W held onto the wafer supporting means 50A is located somewhat apart from not only the cutting blade 158B but also the cutting blade 158A in the direction shown by the arrow 190. The support shaft 120 and the second subsidiary support frame 136 are moved by a predetermined distance in the y-axis direction by the cutting blade interval setting-up means 122 in the cutting means 8. Therefore, the rotating shaft 152B mounted on the second subsidiary support frame 136 and the cutting blade 158B fixed to its head end are moved by the predetermined distance in the y-axis direction from the predetermined distance in the y-axis direction from the aforesaid initial position. It is essential that the predetermined distance of the movement of the cutting blade 158B should be in accurate agreement with the adjacent cutting line interval P1 in the first set of cutting lines CL1 (or the adjacent cutting line interval P2 in the second set of cutting lines CL2) in the wafer W to be cut or should be accurately an integral number times the distance of it. (See FIG. 4 as well.) As a result, the y-axis direction interval between the cutting blade 158A and the cutting blade 158B is set up to be accurate agreement with the adjacent cutting line interval P1 or (P2) or be accurately an integral number times the distance of it. Subsequently, the first subsidiary support frame 134 is caused to pivot in the direction shown by the arrow 184 in FIG. 3 by the first pivoting means 160A to lower the cutting blade 158A down to a predetermined cutting position and the second subsidiary support frame 136 is caused to pivot in the direction shown by the arrow 180 in FIG. 3 by the second pivoting means 160B to lower the cutting blade 158B down to a predetermined cutting position. The cutting positions of the cutting blades 158A and 158B may be set up so that the outer peripheral lower ends of the cutting blades 158A and 158B are positioned a little above the surface of the wafer supporting means 50A. Consequently, when the wafer W is cut by the cutting blades 158A and 158B to be described hereinafter, in the case where the wafer W is attracted onto the wafer supporting means 50A by itself, the wafer W is partially cut with a little non-cutting portion remaining at its back surface. Therefore, even when the wafer W is cut along all the cutting lines CL1 and CL2, the wafer W keeps being maintained as one body without being separated into the individual rectangular areas RA. (In this case, as is well known among those skilled in the art, in the following step, the remaining non-cutting portion is broken by applying a little force to the wafer W and the individual rectangular areas RA are separated.) On the other hand, in the case where the wafer W mounted on the frame by the tape as described hereinbefore is attracted onto the wafer supporting means 50A, the wafer W is cut over its entire thickness but the tape is not cut to remain. Therefore, when the wafer W is cut along all the cutting lines CL1 and CL2, although the wafer W is completely separated into the individual rectangular areas RA, the individual rectangular areas RA keep being maintained as one body by the tape. (In this case, as is well known among those skilled in the art, in the following step, the tape is torn and the individual rectangular areas RA are actually separated.)

Thereafter, the blade rotating means 154A and 154B are energized to rotate the cutting blades 158A and 158B in the direction shown by the arrow 186 at a speed of 15,000 to 20,000 r.p.m. for example. On the other hand, the main movable frame 14A is moved for cutting from the aforesaid one-side deviation position to a the-other-side deviation position in the direction shown by the arrow 188 at a relatively low speed of about 100 mm/sec for example, by the main moving means 20A. At said the-other-side deviation position, the entire wafer W held onto the wafer supporting means 50A by suction is located somewhat apart from not only the cutting blade 158A but also the cutting blade 158B in the direction shown by the arrow 188. Consequently, while the main movable frame 14A is moved for cutting as described above, the rotating cutting blade 158A cuts the wafer W along one cutting line CL1 (or CL2) and the rotating cutting blade 158B simultaneously cuts the wafer W along another cutting line CL1 (or CL2).

In the next place, the blade rotating means 154A and 154B are deenergized to stop the rotation of the cutting blades 158A and 158B. Then, the first subsidiary support frame 134 is caused to pivot in the direction shown by the arrow 180 in FIG. 3 by the first pivoting means 160A to elevate the cutting blade 158A up to a non-cutting position not interfering with the wafer W and the second subsidiary support frame 136 is caused to pivot in the direction shown by the arrow 184 in FIG. 3 by the second pivoting means 160B to elevate the cutting blade 158B up to a non-cutting position not interfering with the wafer W. Furthermore, the main support frame 96 is moved by a predetermined distance in the y-axis direction by the y-axis direction moving means 106 in the cutting means 8 to thus move both of the cutting blades 158A and 158B by the predetermined distance in the y-axis direction. As is easily understood, the predetermined distance movement of the cutting blades 158A and 158B is a so-called pitch sending and it is essential that its distance should be in accurate agreement with the adjacent cutting line interval P1 in the first set of cutting lines CL1 (or the adjacent cutting line interval P2 in the second set of cutting lines CL2) or should be accurately an integral number times the distance of it. On the other hand, the main movable frame 14A is returned from said the-other-side deviation position to the one-side deviation position in the direction shown by the arrow 190 by the main moving means 20A. Thereafter, the cutting ofthe wafer W by the cutting blades 158A and 158B is carried out as described above.

In the aforesaid cutting procedures, while the main movable frame 14A is returned from said the-other-side deviation position to the one-side deviation position, cutting of the wafer W is not carried out. If desired, however, even when the main movable frame 14A is returned, the cutting blades 158A and 158B may be lowered to cutting positions and rotated to thus carry out cutting of the wafer W by the cutting blades 158A and 158B. In this case, it is preferable from the viewpoint of the cutting characteristics of the wafer W by the cutting blades 158A and 158B to rotate the cutting blades 158A and 158B in the reverse direction shown by the arrow 186 when returning the main movable frame 14A.

By repeatedly carrying out the above-described cutting procedures including the cutting movement of the main movable frame 14A, the pitch sending of the cutting blades 158A and 158B and the return movement of the main movable frame 14A, the wafer W is cut along all of its first set of cutting lines CL1 (or its second set of cutting lines CL2). Thereafter, while the main movable frame 14A is stopped at the one-side deviation position, the wafer supporting means 50A is rotated substantially through 90 degrees by the rotating means 58A to thus rotate the wafer W held onto the wafer supporting means 50A through 90 degrees. In addition, in the case where the adjacent cutting line interval P1 in the first set of cutting lines CL1 and the adjacent cutting line interval P2 in the second set of cutting lines CL2 are different from each other, the support shaft 120 and the second subsidiary support frame 136 are moved by a required distance in the y-axis direction by the cutting blade interval setting-up means 122, and therefore the rotating shaft 152B mounted on the second subsidiary support frame 136 and cutting blade 158B fixed to its head end are moved by the required distance in the y-axis direction. Consequently, the y-axis direction interval between the cutting blade 158A and the cutting blade 158B is set up again to be in accurate agreement with the adjacent cutting line interval P2 in the second set of cutting lines CL2 (or the adjacent cutting line interval P1 in the first set of cutting lines CL1) or to be accurately an integral number times the distance of it. Thereafter, the above-described cutting procedures including the cutting movement of the main movable frame 14A, the pitch sending of the cutting blades 158A and 158B, and the return movement of the main movable frame 14A are repeatedly carried out. As a result, the wafer W is cut along all of the remaining second set of cutting lines CL2 (or the remaining first set of cutting lines CL1).

Dicing of the wafer W held to the wafer supporting means 50B mounted on the main movable frame 14B is carried out similarly to the above-described cutting procedures.

In the above-described dicing machine constructed in accordance with this invention, since the wafer transferring means 6 includes the two wafer supporting means 50A and 50B, while the cutting of the wafer W supported with one wafer supporting means 50A or (50B) is carried out in the single cutting station 2, the alignment of the wafer W supported with the other wafer supporting means 50B (or 50A) can be carried out in the alignment station 4B (or 4A). Therefore, the dicing time necessary for dicing the single wafer W can be shortened substantially only to the time required for actually cutting the wafer W in the cutting station 2 to thus largely improve its dicing efficiency. Furthermore, the cutting means 8 includes the two cutting blades 158A and 158B, and the interval of the two cutting blades 158A and 158B can be properly set up. Therefore, even when the cutting line interval in the wafer W varies, the wafer W can be cut along two cutting lines parallel to each other by one relative cutting movement of the cutting means 8 and the wafer supporting means 50A or 50B in a predetermined direction without having any problems to thus largely shorten the time itself required for actually cutting the wafer W in the cutting station 2 and largely improve its dicing efficiency even from this viewpoint. If desired, the cutting means 8 may be equipped with three or more than three cutting blades whose relative intervals can be suitably set up, and the wafer W may be cut along three or more than three cutting lines parallel to one another by one relative cutting movement of the cutting means 8 and the wafer supporting means 50A or 50B in a predetermined direction.

While one embodiment of the dicing machine according to the present invention has been described in detail hereinabove with reference to the accompanying drawings, it should be understood that the present invention is not limited to this embodiment, and various changes and modifications are possible without departing from the scope of this invention.

What is claimed is:

1. A dicing machine for cutting a semiconductor wafer along cutting lines arranged in a lattice pattern, said dicing machine comprising a cutting station, two alignment stations, cutting means disposed in the cutting station and arranged between said two alignment stations, detecting means disposed in the alignment station for detecting the cutting lines of the wafer, and wafer transferring means including two wafer supporting means mounted rotatably, a main moving means for moving the wafer supporting means, and two rotating means respectively annexed to the two wafer supporting means for rotating the two wafer supporting means respectively, one of the two wafer supporting means being movable between one of the two alignment stations and the cutting station while the other of the wafer supporting means is movable between the other of the alignment stations and the cutting station, and said dicing machine being capable of positioning one of the two wafer supporting means in the alignment station, detecting the cutting lines of a semiconductor wafer supported with said one of the wafer supporting means by detecting means and performing alignment including rotating said one of the wafer supporting means on the basis of this detection while positioning the other of the wafer supporting means in the cutting station and cutting a semiconductor wafer supported with said the other of the supporting means by the cutting means.

2. The dicing machine of claim 1 wherein each of the two wafer supporting means is linearly movable between each of the two alignment stations and the cutting station.

3. The dicing machine of claim 2 wherein the linear moving direction of one of the two wafer supporting means and the linear moving direction of the other of the wafer supporting means correspond to each other, the wafer transferring means includes two of the main moving means separately and independently annexed to the two wafer supporting means respectively, the cutting means includes a rotatably mounted rotating shaft, a cutting blade fixed to the rotating shaft and a blade rotating means for rotating the rotating shaft, the rotating shaft of the cutting means extends in the y-axis direction perpendicular to the x-axis direction where the linear moving direction of the wafer supporting means is the x-axis direction, and each of the two wafer supporting means is adapted to be moved in the x-axis direction when cutting the wafer supported with each of the wafer supporting means by the cutting means in the cutting station.

4. The dicing machine of claim 3 wherein the wafer transferring means further includes two main movable frames mounted linearly movably in the x-axis direction, the two wafer supporting means are rotatably mounted on the two main movable frames respectively, each of the two main moving means is drivingly connected to each of the main movable frames to linearly move the main movable frame in the x-axis direction to thus linearly move each of the wafer supporting means in the x-axis direction, and each of the two rotating means is drivingly connected to each of the wafer supporting means to directly rotate the wafer supporting means.

5. The dicing machine of claim 4 wherein the wafer transferring means further includes two subsidiary movable frames respectively mounted on the two main movable frames for linear movement in the y-axis direction and two subsidiary moving means drivingly connected respectively to the subsidiary movable frames for linearly moving the subsidiary movable frames in the y-axis direction respectively, and the two wafer supporting means are rotatably mounted on the subsidiary movable frames respectively.

6. The dicing machine of claim 3 wherein the rotating shaft of the cutting means is mounted for linear movement in the y-axis direction and for movement in the z-axis direction perpendicular to both the x-axis direction and the y-axis direction, and the cutting means further includes a y-axis direction moving means for linearly moving the rotating shaft in the y-axis direction and a z-axis direction moving means for moving the rotating shaft in the z-axis direction.

7. The dicing machine of claim 6 wherein the cutting means includes two of the rotating shafts and two of the cutting blades, one of the two rotating shafts is mounted linearly movably relative to the other in the y-axis direction, and the cutting means further includes a cutting blade interval setting-up means for linearly moving said one of the rotating shafts relative to said the other in the y-axis direction.

8. The dicing machine of claim 7 wherein the cutting means further includes a main support frame mounted linearly movably in the y-axis direction, a first subsidiary support frame mounted on the main support frame and a second subsidiary support frame mounted on the main support frame for linear movement in the y-axis direction; said the other of the two rotating shafts is rotatably mounted on the first subsidiary support frame; said one of the rotating shafts is rotatably mounted on the second subsidiary support frame; the y-axis direction moving means is drivingly connected to the main support frame to linearly move the main support frame in the y-axis direction to thus linearly move both of the two rotating shafts in the y-axis direction; and the cutting blade interval setting-up means is drivingly connected to the second subsidiary support frame to linearly move the second subsidiary support frame in the y-axis direction to thus linearly move said one of the two rotating shafts in the y-axis direction.

9. The dicing machine of claim 8 wherein the cutting means includes two of the blade rotating means separately annexed to the two rotating shafts respectively.

10. The dicing machine of claim 8 wherein the main support frame has a support shaft extending in the y-axis direction, and the first subsidiary support frame and second subsidiary support frame are mounted on the support shaft.

11. The dicing machine of claim 10 wherein the first subsidiary support frame and the second subsidiary support frame are separately and independently mounted pivotably about the central axis of the support shaft as a center, the z-axis direction moving means includes a first pivoting means and a second pivoting means separately and independently annexed to the first subsidiary support frame and the second subsidiary support frame respectively, the first pivoting means and the second pivoting means respectively cause the first subsidiary support frame and the second subsidiary support frame to pivot about the central axis of the support shaft as a center to thus move said the other and said one of the rotating shafts in the z-axis direction respectively.

12. A dicing machine for cutting a semiconductor wafer along cutting lines arranged in a lattice pattern, said dicing machine comprising a cutting means and a wafer supporting means, and said cutting means and wafer supporting means being adapted to be linearly moved relative to each other in a predetermined direction whereby the wafer supported with the wafer supporting means is cut by the cutting means, the wafer supporting means being mounted movably in the x-axis direction, a moving means for moving the wafer supporting means in the x-axis direction, and the wafer supporting means being adapted to be moved in the x-axis direction by the moving means when the wafer supported with the wafer supporting means is cut by the cutting means, said cutting means including two rotating shafts extending in the y-axis direction perpendicular to the x-axis direction where the relative linear moving direction of the cutting means and wafer supporting means is the x-axis direction, two cutting blades fixed to the two rotating shafts respectively and a blade rotating means for rotating the two rotating shafts, the two rotating shafts of the cutting means being mounted for linear movement in the y-axis direction and for movement in the z-axis direction perpendicular to both the x-axis direction and the y-axis direction, the cutting means further including a y-axis direction moving means for linearly moving the rotating shafts in the y-axis direction and a z-axis direction moving means for moving the rotating shafts in the z-axis direction, one of said two rotating shafts being mounted linearly movable relative to the other in the y-axis direction, the cutting means further including a main support frame mounted linearly movably in the y-axis direction, a first subsidiary support frame mounted on the main support frame and a second support frame mounted on the main support frame for linear movement in the y-axis direction; said the other of the two rotating shafts is rotatably mounted on the first subsidiary support frame; said one of the rotating shafts is rotatably mounted on the second subsidiary support frame; the y-axis direction moving means is drivingly connected to the main support frame to linearly move the main support frame in the y-axis direction to thus linearly move both of the two rotating shafts in the y-axis direction; and the cutting blade interval setting-up means is drivingly connected to the second subsidiary support frame in the y-axis direction to thus linearly move said one of the two rotating shafts in the y-axis direction, said cutting means further including a cutting blade interval setting-up means for linearly moving said one of the two rotating shafts relative to said the other in the y-axis direction.

13. The dicing machine of claim 12 wherein the cutting means includes two of the blade rotating means separately annexed to the two rotating shafts respectively.

14. The dicing machine of claim 12 wherein the main support frame has a support shaft extending in the y-axis direction, and the first subsidiary support frame and second subsidiary support frame are mounted on the support shaft.

15. The dicing machine of claim 14 wherein the first subsidiary support frame and the second subsidiary support frame are separately and independently mounted pivotably about the central axis of the support shaft as a center, the z-axis direction moving means includes a first pivoting means and a second pivoting means separately and independently annexed to the first subsidiary support frame and the second subsidiary support frame respectively, the first pivoting means and the second pivoting means respectively cause the first subsidiary support frame and the second subsidiary support frame to pivot about the central axis of the support shaft as a center to thus move said the other and said one of the rotating shafts in the z-axis direction respectively.

* * * * *